US007458200B2

(12) United States Patent
Kish

(10) Patent No.: US 7,458,200 B2
(45) **Date of Patent: *Dec. 2, 2008**

(54) HIGH ELONGATION CABLE

(75) Inventor: James Christopher Kish, Akron, OH (US)

(73) Assignee: The Goodyear Tire & Rubber Co., Akron, OH (US)

( * ) Notice: Subject to any disclaimer, the term of this patent is extended or adjusted under 35 U.S.C. 154(b) by 333 days.

This patent is subject to a terminal disclaimer.

(21) Appl. No.: 11/297,291

(22) Filed: Dec. 8, 2005

(65) Prior Publication Data

US 2007/0130905 A1 Jun. 14, 2007

(51) Int. Cl.
*D02G 3/22* (2006.01)

(52) U.S. Cl. ..... 57/237

(58) Field of Classification Search ..... 57/236, 57/237; 152/527, 556

See application file for complete search history.

(56) References Cited

U.S. PATENT DOCUMENTS

| | | | | |
|---|---|---|---|---|
| 2,133,071 | A * | 10/1938 | Anderson et al. | 57/237 |
| 2,971,321 | A * | 2/1961 | Himmelfarb et al. | 57/237 |
| 3,016,682 | A * | 1/1962 | Gaston | 57/237 |
| 3,395,529 | A * | 8/1968 | Ray | 57/237 |
| 4,102,118 | A * | 7/1978 | Wheeler | 57/236 |
| 6,619,357 | B1 | 9/2003 | Gillard et al. | 152/531 |
| 6,863,103 | B1 | 3/2005 | Masubuchi et al. | 152/451 |
| 2003/0106300 | A1 * | 6/2003 | Bruyneel et al. | 57/212 |
| 2003/0226347 | A1 * | 12/2003 | Smith et al. | 57/210 |
| 2005/0126674 | A1 | 6/2005 | Hardy et al. | 152/527 |
| 2007/0131331 | A1 * | 6/2007 | Neubauer et al. | 152/527 |

FOREIGN PATENT DOCUMENTS

| | | |
|---|---|---|
| EP | 1 479 535 A2 | 11/2004 |
| EP | 1 386 757 A1 | 2/2005 |

OTHER PUBLICATIONS

European Search Report, completed Mar. 9, 2007.

* cited by examiner

*Primary Examiner*—Shaun R Hurley
(74) *Attorney, Agent, or Firm*—June E. Rickey

(57) ABSTRACT

A high elongation cable and a tire having a tread belt with an extensible reinforcing cable are provided. The high elongation cable has a 3×7×m or a 4×7×m construction, wherein m is comprised of at least two layers, wherein the outermost layer is comprised of a plurality of twisted filaments, said filaments having a diameter d, wherein the spacing between said twisted filaments is less than the diameter d.

4 Claims, 3 Drawing Sheets

HIGH ELONGATION CABLE

FIELD OF THE INVENTION

The disclosed invention is directed towards a steel cable construction, and the use of the steel cable as a reinforcement means in the tread belt of a tire.

BACKGROUND OF THE INVENTION

The tread belt and pneumatic tires of the present invention are generally designed for use on large earthmover vehicles and are subjected to high stress and loads under harsh environmental conditions such as in rock quarries, mines, foundries, and other areas where tires are subjected to puncture-producing and wear-inducing conditions.

The large pneumatic tires, which are typically used for earthmoving vehicles, sometimes fail due to the high stress and loads caused by the harsh environmental conditions in which they are operated. With the continual drive to improve earthmover performance, there is a continuing need to provide novel methods and tire designs for improving earthmover tire durability.

SUMMARY OF THE INVENTION

The invention provides in a first aspect a high elongation cable having a 3×7×m construction or a 4×7×m construction. M is comprised of at least two layers, wherein the outermost layer is comprised of a plurality of twisted filaments, said filaments having a diameter d, wherein the spacing between said twisted filaments is less than the diameter d.

The invention provides in a second aspect a high elongation cable having a 3×7×m or a 4×7×m construction, wherein m is selected from the group consisting essentially of: [1+6+12×0.22], [3×0.20+7×0.23], [3+9×0.25], and [1+6×0.35].

DEFINITIONS

For ease of understanding this disclosure, the following terms are disclosed:

"Axial" and "axially" mean lines or directions that are parallel to the axis of rotation of the tire;

"Bead" means that part of the tire comprising an annular tensile member wrapped by the carcass ply and shaped, with or without other reinforcement elements such as flippers, chippers, apexes, toe guards and chafers, to fit the design rim;

"Belt or breaker reinforcing structure" means at least two layers of plies of parallel strands, woven or unwoven, underlying the tread, unanchored to the bead;

"Cable" means at least two strands bunched or stranded together to form a reinforcing structure;

"Circumferential" means lines or directions extending along the perimeter of the surface of the annular tread perpendicular to the axial direction;

"Equatorial plane (EP)" means the plane perpendicular to the tire's axis of rotation and passing through the center of its tread;

"Filament" means a generic term for a continuous strand;

"Nominal rim diameter" means the diameter of the rim base at the location where the bead of the tire seals;

"Normal inflation pressure" refers to the specific design inflation pressure at a specific load assigned by the appropriate standards organization for the service condition for the tire;

"Normal load" refers to the specific load at a specific design inflation pressure assigned by the appropriate standards organization for the service condition for the tire;

"Ply" means a continuous layer of rubber-coated parallel strands;

"Radial" and "radially" mean directions extending radially toward or away from the axis of rotation of the tire; and "Strand" means a reinforcing structure formed of at least one filament. A strand may be used alone for reinforcing or multiple strands may be grouped together to form a cable.

BRIEF DESCRIPTION OF THE DRAWINGS

The invention will be described by way of example and with reference to the accompanying drawings in which.

DETAILED DESCRIPTION OF THE INVENTION

Figure 2A:
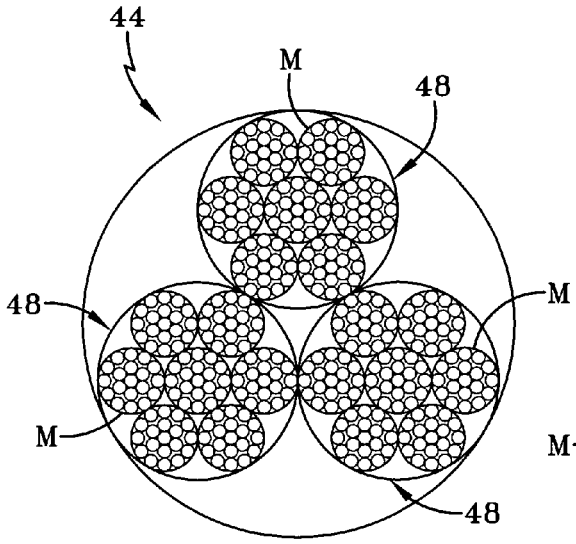
FIGS. 2A-2D are cross-sectional views of cable embodiments of the present invention having a 3×7×m construction.
Figure 2B:
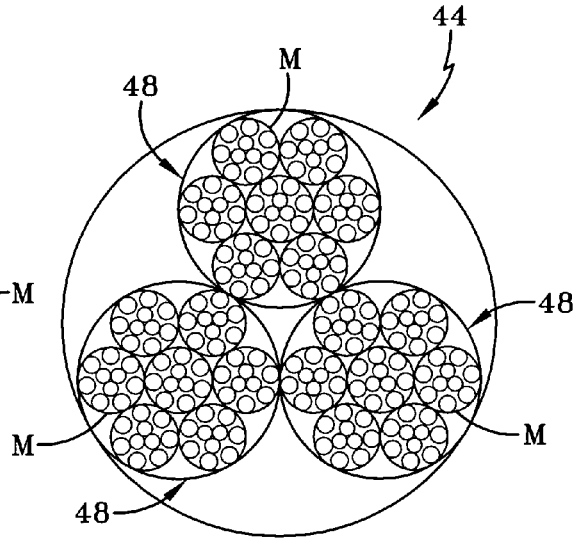
Figure 2C:
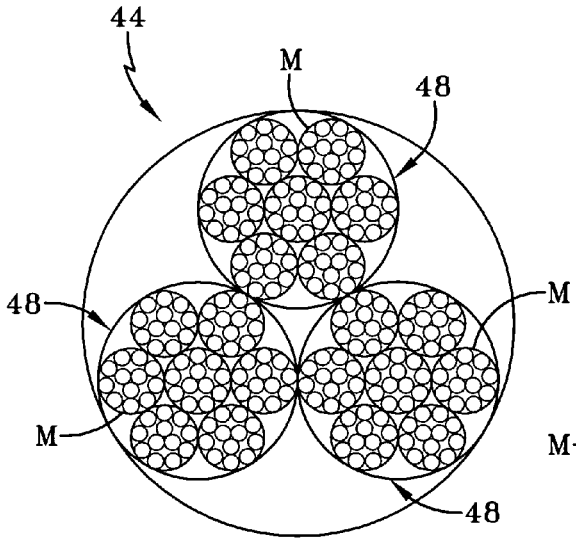
Figure 2D:
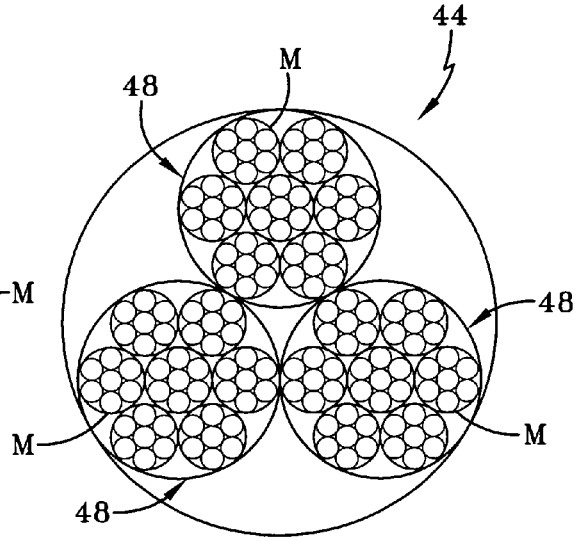

A first embodiment of a large diameter high elongation cable 44 is shown in FIGS. 2A-2D. The cable 44 is comprised of three bundles 48 in a triangular configuration. Each bundle 48 is further comprised of individually pretwisted strands of wire. In this example, each bundle 48 has the same diameter and internal configuration. Each bundle 48 is a substructure of n×m type, wherein n=7 and m is a cord of mostly circular cross-section. The illustrated cable 44 has the overall construction of 3×7×m, excluding filament dimensions. M can be for example, [1+6+12×0.22] as shown in FIG. 2A, [3×0.20+7×0.23] as shown in FIG. 2B, [3+9×0.25] as shown in FIG. 2C, or [1+6×0.35] as shown in FIG. 2D, or as described in more detail, below.

Figure 3:
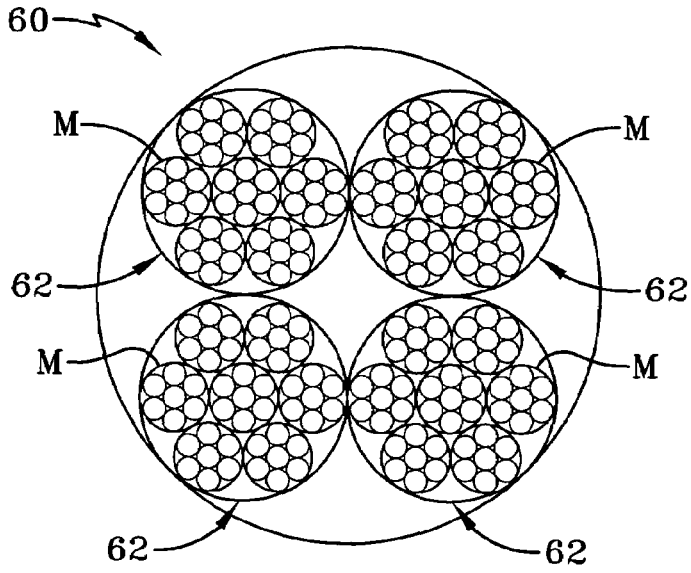
FIG. 3 is a cross-sectional view of a second embodiment of a cable having a 4×7×m construction.

A second embodiment of a large diameter high elongation cable 60 is shown in FIG. 3. The cable 60 is comprised of four bundles 62 in a quad configuration. Each bundle 62 is further comprised of individually pretwisted strands of wire. In this example, each bundle 62 has the same diameter and internal configuration. Each bundle 62 is a substructure of n×m type, wherein n=7 and m is a cord of mostly circular cross-section. The illustrated cable 60 has the overall construction of 4×7×m, excluding filament dimensions M can be for example, [1+6+12×0.22] (not shown), [3×0.20+7×0.23] (not shown), [3+9×0.25] (not shown), or [1+6×0.35] (shown in FIG. 3), or as described in more detail, below.

M is defined as having two or more layers, wherein the first layer is comprised of at least one filament, preferably a centered filament. The outermost layer is comprised of a plurality of twisted filaments wherein the spacing between filaments in the outermost layer is less than one diameter of the filaments in that layer.

It is preferred that the strands described above are twisted. The above cable constructions have utility in applications where high extension (greater than 3%) is needed and the cord diameter is greater than 2.0 mm. The above cable constructions may be used in a two piece tire as described in more detail, below. How the above cable constructions are not limited to a two piece tire, and may be used in belts of conventional tires such as truck tires.

The center voids in the above described configurations could be optionally filled with a filler cord. The filler cord is preferably non-metallic and can be comprised of, for example, nylon, polyester or fiberglass. The filler cord could also be a metal cord such as steel.

EXAMPLE 1

Figure 1:
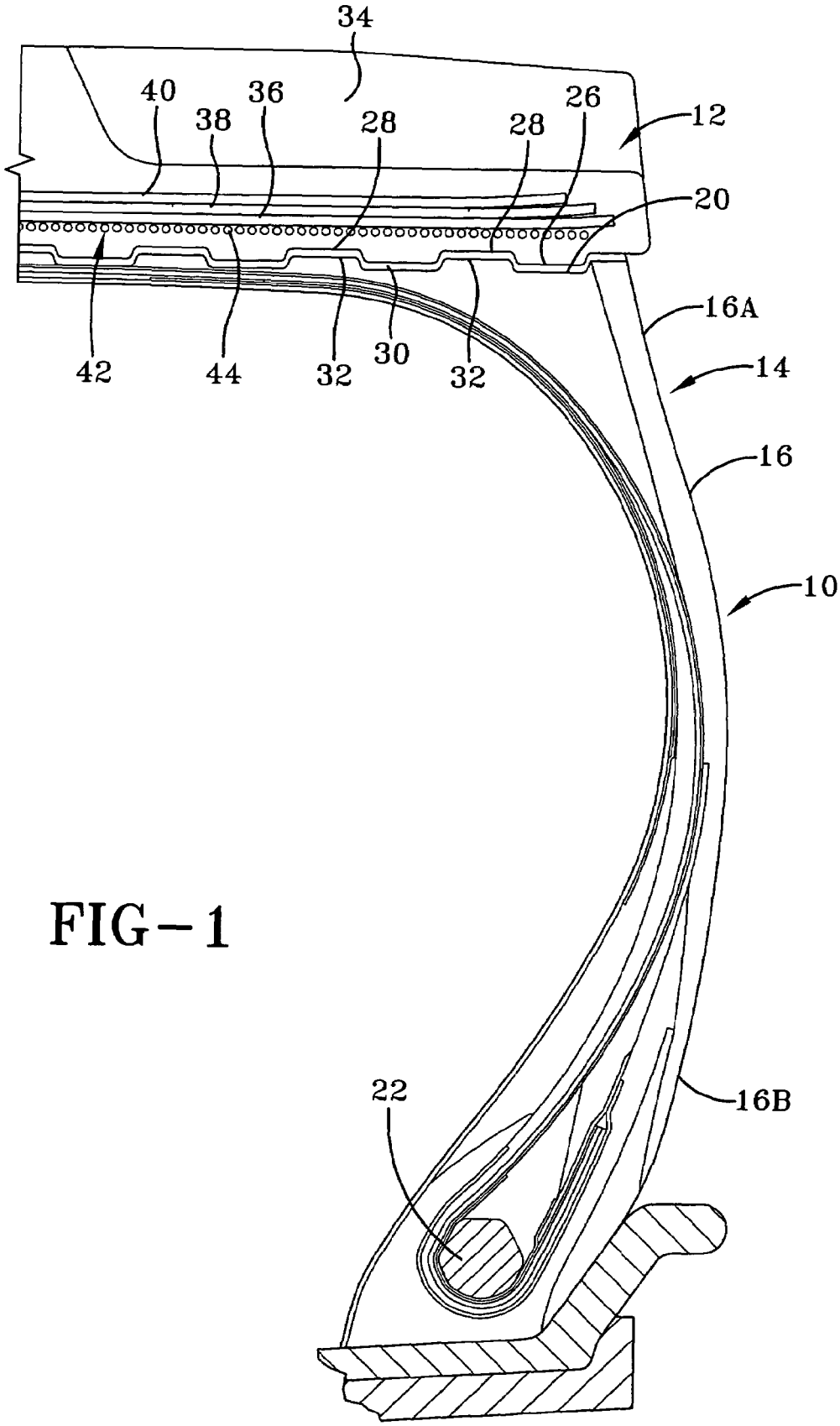
FIG. 1 is a cross-sectional view of one half of a two-piece tire.

With reference to FIG. 1, there is illustrated a cross-section of a two-piece pneumatic tire 10. The tire 10 includes a ground engaging, circumferentially extending tread belt 12 mounted on a radially reinforced, beaded tire carcass 14. The beaded tire carcass 14 generally includes a pair of tire sidewalls 16 extending radially inwardly from the outer circumferential surface 20 of the tire carcass and terminating at their radial extremities in a pair of bead wires 22. The sidewalls 16 each have an upper portion 16A in the shoulder region of tire carcass 14 and radially inward of the maximum section width of the tire carcass, and a lower portion 16B adjacent the bead wires 22 and radially inward of the maximum section width of the tire carcass 14. The details of the construction of tire carcass 14 are best described in co-owned patent applications Ser. No. 09/840,385, filed Apr. 23, 2001 and Ser. No. 10/339,199, filed Jan. 9, 2003, both of which are fully incorporated herein by reference.

The ground engaging, circumferentially extending tread belt 12 is manufactured, i.e. built or assembled and cured, separately from the tire carcass 14 and is removably mounted onto the tire carcass 14. The underside or inner circumference surface of tread belt 12 may optionally comprise one or more annular lands 26 and grooves 28 that mate with grooves 30 and lands 32 of tire carcass 14 to restrain tread belt 12 from lateral or axial movement with respect to the carcass 14. The tire tread belt 12 includes a tread portion 34 and a plurality of belts layers 36, 38, 40.

The radially inner belt layers 36, 38 are reinforced with cables. Each tread belt layer 36, 38 has the cables oriented at an angle in the range of about 15° to about 60° relative to the circumferential direction. Preferably, the cables in these adjacent layers 36, 38 are inclined at relatively equal angles but oppositely oriented. The radially outermost third layer 40 has strands oriented at an angle greater than 80° relative to the circumferential direction.

The reinforcing means in the three layers 36, 38, 40 may be constructed from any conventional reinforcing strands or any strands that may be developed that are useful for reinforcing elastomeric articles. Known materials include, but are not limited to, aramid, polyester including PET and PEN, all types of nylon, carbon fiber, steel, and fiberglass. Alternatively, the reinforcing means in the three layers 36, 38, 40 may be a high elongation cable such as described in the examples above or a commercially available high elongation cable. The strands in the third layer 40 may the same or have a different strand construction as the strands in the two layers 36, 38.

Radially inward of these belt layers 36, 38, 40 is a reinforcement layer 42 which is also a strength and load carrying layer. The layer is reinforced with cables 44 oriented at 0°, plus or minus 1-3°, relative to the circumferential direction. The belt layer 42 encircles the tire tread belt 12 and restricts the radially outward growth of the tread belt 12 that can be caused by serious deflection in the tire carcass 14. By keeping the tire tread belt 12 from expanding radially outward, the tread 34 will maintain a more flat tread profile thereby improving tread life and durability. The zero degree oriented layer 42 also eliminates the need for a larger number of belt layers than specified herein.

The reinforcing means in the zero degree layer 42 may be constructed from any conventional reinforcing strands or any strands that may be developed that are useful for reinforcing elastomeric articles. Known materials include, but are not limited to, aramid, polyester including PET and PEN, all types of nylon, carbon fiber, steel, and fiberglass. Alternatively, the reinforcing means in layer 42 may be a high elongation cable such as described in the examples above or a commercially available high elongation cable.

Figure 4:
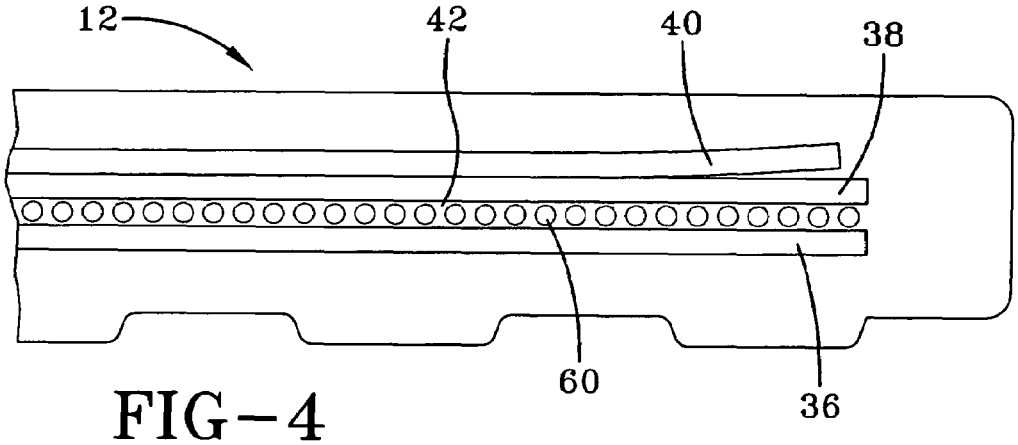
FIGS. 4-5 are alternative embodiments of the lay-up order in the tread belt.
Figure 5:
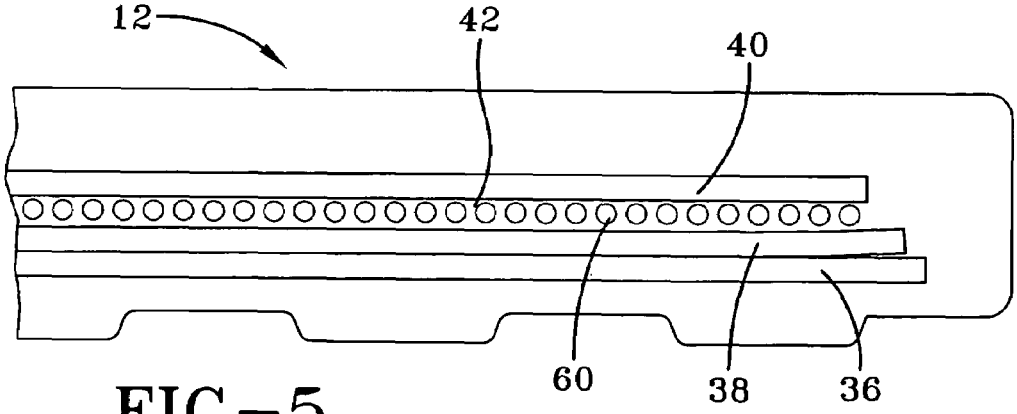

While one lay-up order of the belts 36, 38, 40, 42 is illustrated, the lay-up order may be modified to vary the tread belt characteristics. The zero-degree layer 42 may be located between the inclined belt layers 36, 38, see FIG. 4, or radially outward of the inclined belt layers 36, 38, see FIG. 5. Alternatively, the 90° layer 40 may be located radially beneath the inclined belt layers 36, 38.

While three tread belts, in combination with a single zero degree belt, are illustrated, it is within the scope of the invention to use other numbers of tread belt layers as needed. The combination of a removable tire tread belt 12 with a tire carcass 14 for use with large earthmoving vehicles is important in that it enables a portion of a tire 10 to be replaced instead of the entire tire in the event that one portion of the tire, i.e., the tire belt 12 or the tire carcass 14, wears out before the other part. Also, it may be desirable to have different types of tread designs such as, for example, driving or steering tread designs. This feature allows for a less expensive means of changing the tire tread to construct the appropriate style of desired tire. This feature would greatly reduce the cost of storing spare tires and could even extend the operating time of the tires.

What is claimed is:

1. A high elongation cable having a 3×7×m construction, wherein m is comprised of two or more layers, wherein the outermost layer is comprised of a plurality of twisted filaments, said filaments having a diameter d, wherein the spacing between said twisted filaments is less than the diameter d, wherein m is comprised of at least two layers, wherein m is selected from the group consisting essentially of: [1+6+12×0.22], [3×0.20+7×0.23], [3+9×0.25], and [1+6×0.35], and wherein the cable has a tensile strength of at least 27,500 N and 3% elongation.

2. The cable of claim 1 wherein the cable has a tensile strength of at least 50,000 N and 3% elongation.

3. A high elongation cable having a 4×7×m construction, wherein m is comprised of two or more layers, wherein the outermost layer is comprised of a plurality of twisted filaments, said filaments having a diameter d, wherein the spacing between said twisted filaments is less than the diameter d, wherein m is selected from the group consisting essentially of: [1+6+12×0.22], [3×0.20+7×0.23], [3+9×0.25], and [1+6×0.35], and wherein the cable has a tensile strength of at least 27,500 N and 3% elongation.

4. The cable of claim 3 wherein the cable has a tensile strength of at least 50,000 N and 3% elongation.

This listing of claims will replace all prior versions and listings of claims in the application.

* * * * *